US011771930B1

(12) United States Patent
Shah

(10) Patent No.: US 11,771,930 B1
(45) Date of Patent: Oct. 3, 2023

(54) HYBRID FACE MASK ASSEMBLY

(71) Applicant: Dinesh V. Shah, Largo, FL (US)

(72) Inventor: Dinesh V. Shah, Largo, FL (US)

( * ) Notice: Subject to any disclaimer, the term of this patent is extended or adjusted under 35 U.S.C. 154(b) by 345 days.

(21) Appl. No.: 17/166,542

(22) Filed: Feb. 3, 2021

Related U.S. Application Data

(60) Provisional application No. 63/204,571, filed on Oct. 13, 2020, provisional application No. 63/103,332, filed on Aug. 3, 2020, provisional application No. 63/102,990, filed on Jul. 13, 2020.

(51) Int. Cl.
*A62B 23/00* (2006.01)
*A62B 23/06* (2006.01)
*A41D 13/11* (2006.01)

(52) U.S. Cl.
CPC ..... *A62B 23/06* (2013.01); *A41D 13/1161* (2013.01)

(58) Field of Classification Search
CPC ..... A62B 23/06; A41D 13/1161
See application file for complete search history.

(56) References Cited

U.S. PATENT DOCUMENTS

| | | | | |
|---|---|---|---|---|
| 2,012,505 | A | 8/1935 | Goldsmith | |
| 4,319,567 | A | 3/1982 | Magidson | |
| 4,606,341 | A | 8/1986 | Hubbard et al. | |
| 5,568,808 | A | 10/1996 | Rimkus | |
| 5,890,491 | A | 4/1999 | Rimkus | |
| 6,055,982 | A | 5/2000 | Brunson et al. | |
| 6,412,486 | B1 | 7/2002 | Glass | |
| 9,095,735 | B2 * | 8/2015 | Kashmakov | A62B 23/06 |
| 11,064,744 | B1 * | 7/2021 | Palacios | A41D 13/1107 |
| 2022/0053851 | A1 * | 2/2022 | Nickel | A41D 13/1161 |
| 2022/0062672 | A1 * | 3/2022 | Zimmer | A62B 23/00 |

* cited by examiner

*Primary Examiner* — Steven O Douglas
(74) *Attorney, Agent, or Firm* — Mark C. Johnson; Johnson |Dalal

(57) ABSTRACT

A hybrid disposable face mask has a first mask section having a filter area sized and shaped to fit in overlapping relationship only about the mouth area of the wearer and a second mask section having inserts, one for each nostril, sized and shaped to be sealably retained air tight in each nostril. The second mask section can be linked to a valve assembly which opens during exhale and closes during inhale. The first mask section may be supported solely by the second mask section or by separate structure. The combination allows one to eat and drink while breathing through the nose filter.

12 Claims, 7 Drawing Sheets

HYBRID FACE MASK ASSEMBLY

CROSS-REFERENCE TO RELATED APPLICATIONS

This application claims the benefit of U.S. Provisional Application No. 63/102,990 filed Jul. 7, 2020, U.S. Provisional No. 63/103,332 filed Jul. 28, 2020, and U.S. Provisional No. 63/204,571 filed Oct. 13, 2020, the entire contents of which are incorporated by reference.

BACKGROUND OF THE INVENTION

The present invention relates to face masks that are used to prevent inhalation and exhalation of bacteria or viruses and, more particularly, to a hybrid mask incorporating separate filtration of mouth and nasal airways. The mouth masks may be disposable, single use mouth covering masks in conjunction with a nose filter.

There are a variety of face masks used by medical personnel and which are now being worn by the general public since the outbreak of the pandemic generally known as Covid-19. The masks in general cover the mouth and nose area of the wearer so that inhaled and exhaled air passes through the filter media of the masks. Because an effective mask is made of a relatively dense filter media and not enough pressure is generated by exhaling, exhaled air does not easily pass through the media so that some air is trapped in the media and may be inhaled when the wearer next takes a breath. Further, because the typical disposable mask fits over the nose of the wearer, it is difficult to create an effective seal about the nose resulting in some air being exhaled around the edge of the mask rather than through the filter media. For a mask wearer who also wears eyeglasses, the warm exhaled air may cause fogging of the eyeglasses and diminution of visibility by the wearer. Further, it is common to rebreathe air that has been exhaled and caught within the mask. In addition, when the wearer is attempting to either drink or consume food, the mask is typically removed leaving the wearer subject to inhaling of bacteria or viruses. As noted, current face masks create other problems. There are numerous examples of people getting sick or getting lung problems or getting things like headache or congestion while inhaling exhaled air within face mask and face masks are removed in places like restaurants and bars and gymnasium where viruses and bacterium are high. Nose filters, such as those shown in U.S. Pat. Nos. 5,890,491 and 5,568,808 make it harder to breathe with small top breath area and volumetric filter mass that gives high air transfer resistance, nasal fluid filter gets clogged and makes breathing much harder as well as less air can pass through filter, some nasal filters require flange or adhesive to provide sealing, and viruses or bacteria can enter through mouth if nose filter is used alone. In addition, the prior art does not show a spring clip or an insert, shaped and sized with flexibility, to hold nose filter tight inside a nose.

One type of mask is illustrated in U.S. Pat. No. 2,012,505 entitled "Mask," issued on Aug. 27, 1935 to S. J. Goldsmith. Another type of disposable face mask is illustrated in U.S. Pat. No. 4,319,567 entitled "Disposable Face Mask," issued on Mar. 16, 1982 to M. Magidson. This mask is molded and has been especially configured in an effort to avoid leakage of fluid flow past the edges of the mask. U.S. Pat. No. 4,606,341 ("the '341 Patent) entitled "Noncollapsible Surgical Face Mask," issued Aug. 19, 1986 to Vance M. Hubbard and Welton K. Brunson shows a conventional rectangular face mask having a trapezoidal pleat. For some operating conditions, rectangularly shaped masks, including the mask shown in the '341 Patent, may have less than an optimal fit to prevent the passage of liquids and aerosols between the periphery of the masks and a wearer's face. More recently, U.S. Pat. No. 6,055,982 shows a face mask using a pleated and/or non-pleated face covering that incorporates a gasket-type sealing material disposed along the periphery of the mask with elastic straps for holding the mask in place. The straps may pass completely about the head of the wearer or have shorter loops at each that loop around the ears of the wearer. None of these prior art masks solve the problem of maintaining some level of protection while consuming food or drink and otherwise inhaling most air back into the lungs.

Another type of protective breathing apparatus only addresses nasal breathing and is shown, by way of example, in U.S. Pat. No. 9,095,735 ("the '735 Patent) entitled "Nose Filter." The '735 Patent is directed to a nose filter adapted to be inserted into a nostril, and includes a housing having an external shape corresponding to the nostril, for enforcing breathed air to pass through the housing. The housing has filtering membrane(s), for filtering inhaled air; a first air passageway(s), through the filtering membrane(s); a second air passageway(s), bypassing the filtering membrane(s); and valve(s), for enforcing inhaled air to pass through the filtering membrane(s), and bypass the filtering membrane(s) upon exhalation. The valve(s) are operative to block the second air passageway(s) upon inhalation, and operative to open the second passageway(s) upon exhalation. While nose filters are known, such filters do not protect the user from contaminants inhaled through the mouth as well does not protect others while talking to pass on the wearer's germs and viruses.

BRIEF SUMMARY OF THE INVENTION

This invention, a combined use of nose filter and a mouth mask, not only solves problems associated with face mask, in an environment like Covid, but also provides a unique nose filter with means to inhale fresh air and exhale out into mouth mask. This is where one inhales and exhales through the hybrid mask without inhaling a portion of exhaled breath. A unique nose filter solves many of the associated problems with prior art nose filters like easier breathing, keeping filter unclogged from nasal fluid, not inhaling a portion of exhaled air, holding nose filter from sliding out and no use of flange or adhesive. Problems with face masks include breathing most of exhaled air causing all health issues, forfeits the purpose of virus protection in places like restaurants, bars, gymnasium etc., and making glasses foggy from mask opening in situations.

The present invention comprises a hybrid mask that is formed in two parts independent or coupled together to provide an independent air filtration system for both the mouth and nose of the wearer. By having two parts, the part covering the mouth area of the wearer can be lifted above the mouth to allow consuming of food and drink without compromising the filtering of air being inhaled or exhaled through the nose of the wearer. In one embodiment, a first portion or the part of the mask referred to herein as a mouth filter covers the mouth of the wearer and may be formed of conventional disposable filter material, but sized and shaped to fit only about the mouth area of the wearer. Attached to the first portion is a second portion of the mask that comprises a nasal filter. The nasal filter may be of the type shown in U.S. Pat. Nos. 5,890,491; 5,568,808; or 9,095,735 with issues as called out in Prior Art. However, it is preferred to use a nasal filter that is conceived by an applicant that gives larger surface area to make breathing easier, uses a drip protection sponge to keep filter unclogged and thereby more efficient, holding firm in nose with spring clip or friction grip without use of any flange or an adhesive and having means to exhale in mouth mask without inhaling exhaled air.

There are different embodiments to serve the purpose. First embodiment uses a unique nose filter that exhales air into the mouth mask through a tubular link holding a gravity actuated lid or cover in mouth mask towards the other end. Said gravity cover opens with pressure from exhaled air and brings out exhaled air into a mouth mask.

In another embodiment, a mouth mask is hooked to the special nose clip of the nose inserts via a coupling link and able to position over a mouth without having side straps that either goes around a head or the ears. When needed, like eating or drinking said, mask can be unhooked and hooked back thereafter. Coupling link and attachment means can vary with design. Nose clips on nose inserts are designed to hold the nose filter and mouth mask assembly and able to pull out and reinserted in nose by means as designed.

Another embodiment uses a tubular attachment tied to nose inserts at one end and an attachment holds a filter at the other end to breathe in and a gravity actuated lid or cover in between on the tube to exhale out.

In another embodiment a tubular attachment tied to nose inserts at one end and a valve at other end. A valve having a sliding filter spool to hold different positions in said valve to open ports for inhaling and exhaling. Exhale pressure is used to move said filter spool up to close inhale port and open exhale port. Gravity makes the filter drop down when inhaling to open the inhale port.

A unique nose filter has a special filter, special inserts with or without nose clips and a special drip protection sponge. A filter element is molded in shape and size and having a layer to give least air transfer resistance and provide maximum exposed surface area for more air transfer, an insert is formed in shape and size from a flexible material to provide proper grip inside of nose and airtight as possible. A nasal drip or a mucus or an exhalation moisture causes the nasal filter to clog with build-up. This makes not only breathing much harder, but less air passes through the filter. This is where this unique nose filter uses a drip protection sponge layer attached at the top of the nose filter. The sponge can be detached and cleaned or replaced. The sponge holds the nasal fluid before it clogs the filter.

BRIEF DESCRIPTION OF THE DRAWINGS

A more particular description briefly stated above will be rendered by reference to specific embodiments thereof that are illustrated in the appended drawings. Understanding that these drawings depict only typical embodiments and are not therefore to be considered to be limiting of its scope, the embodiments will be described and explained with additional specificity and detail through the use of the accompanying drawings in which.

DETAILED DESCRIPTION OF THE INVENTION

Figure 1:
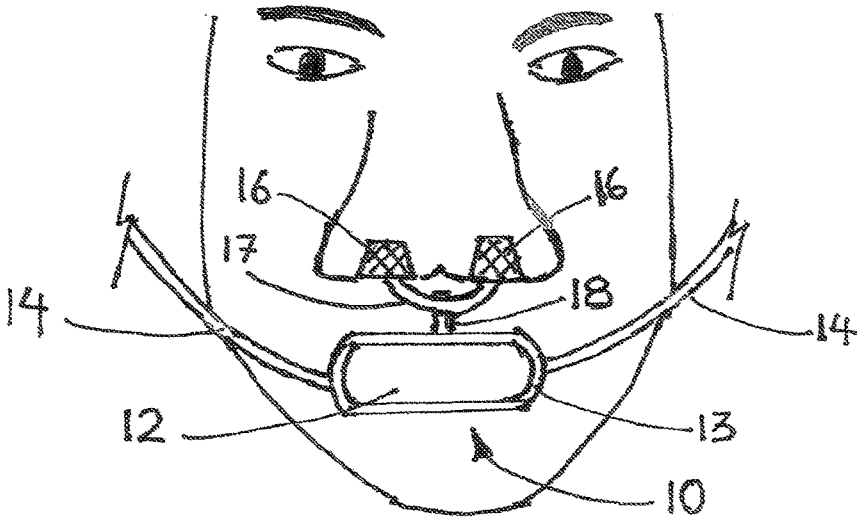
FIG. 1 is an elevation view of a mouth mask to be used with a unique nose filter.

Embodiments are described herein with reference to the attached figures wherein like reference numerals are used throughout the figures to designate similar or equivalent elements. The figures are not drawn to scale and they are provided merely to illustrate aspects disclosed herein. Several disclosed aspects are described below with reference to non-limiting example applications for illustration. It should be understood that numerous specific details, relationships and methods are set forth to provide a full understanding of the embodiments disclosed herein. One having ordinary skill in the relevant art, however, will readily recognize that the disclosed embodiments can be practiced without one or more of the specific details or with other methods. In other instances, well-known structures or operations are not shown in detail to avoid obscuring aspects disclosed herein. The embodiments are not limited by the illustrated ordering of acts or events, as some acts may occur in different orders and/or concurrently with other acts or events. Furthermore, not all illustrated acts or events are required to implement a methodology in accordance with the embodiments.

Notwithstanding that the numerical ranges and parameters setting forth the broad scope are approximations, the numerical values set forth in specific non-limiting examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 4.

Referring to FIG. 1 there is shown one embodiment of a hybrid mask 10 in accordance with the present invention. The hybrid mask 10 incorporates a mouth covering portion 12 which may be formed of various types of well-known filter material such as, for example, a paper product or a non-woven cloth product. Such material is commonly used in masks for medical personnel and may be of the type that is typical of N-95 masks or of other suitable material. Descriptions of material and structure for mouth portion 12 are shown by way of example in U.S. Pat. Nos. 6,055,982 and 6,412,486 as well as patents referenced in those patents. One difference between these prior face masks and the mask portion 12 of the present invention is in the size and general shape of the mouth portion and the use in the prior art of a mask to cover both the nose and mouth of the wearer. In the present invention, mask portion 12 only covers the mouth portion of the wearer and therefore has a smaller footprint that the conventional mask of the prior art. As shown in the drawing figures, mask portion 12 is held in position by strapping 14 that may pass around a head of the wearer and be tied in back. Alternately, the strapping 14 may be of the type shown in the aforementioned U.S. Pat. No. 6,412,486 comprising an elastic loop that fits over the ears of the wearer and holds the mask portion 12 in place. While it is common to use non-elastic material for the strapping 14, it is also contemplated that the strapping 14 could be a continuous elastic loop that fits about the head of the wearer to hold the mask portion 12 in proper position and therefore avoid the need to tie the strapping ends together at the back of the wearer's head. The mask portion 12 may have a resilient border 13 that can be formed for contact with the face to minimize air leakage around the edges of the portion 12.

The hybrid mask 10 also includes a nose or nasal filter 16 that is coupled to the mask portion 12 via a link 18. As will be described with reference to FIGS. 2 and 7, the link 18 may comprise a tube through which air is inhaled and exhaled. Alternately, the link 18 may be a flexible coupling tying the mask portion 12 to the filter 16 in which embodiment the filter 16 is of the inventive form shown in FIGS. 5 and 6.

Figure 2:
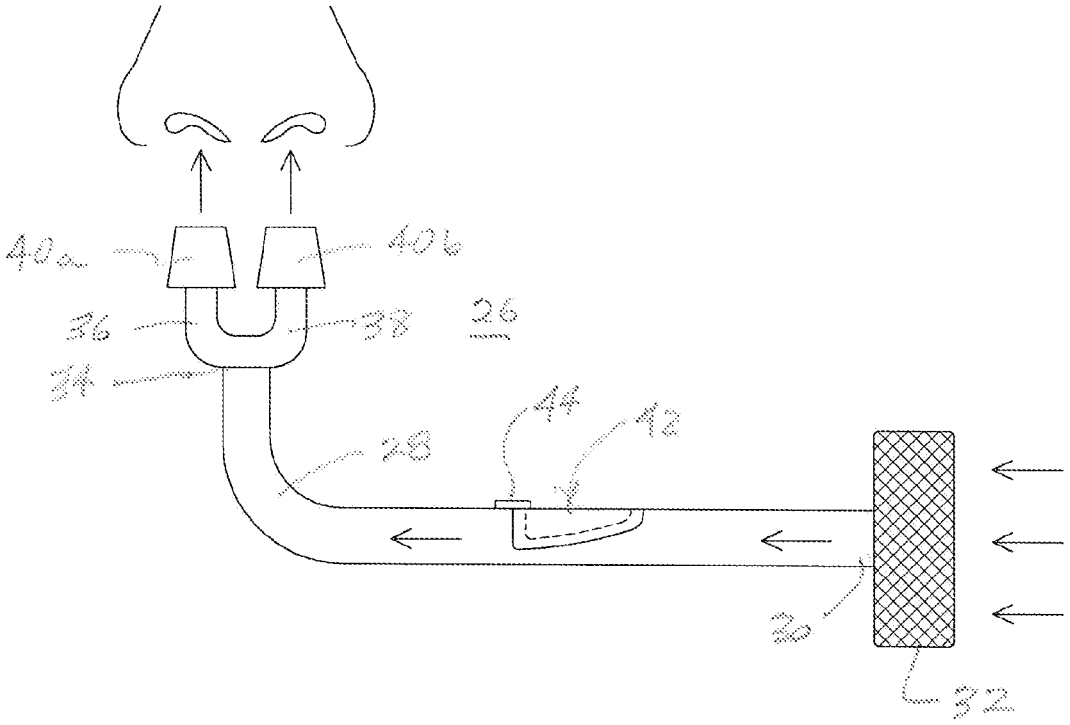
FIG. 2 is a schematic representation of one form of nasal filter using a filter inlet and valved outlet for exhaled air during air inhalation.
Figure 3:
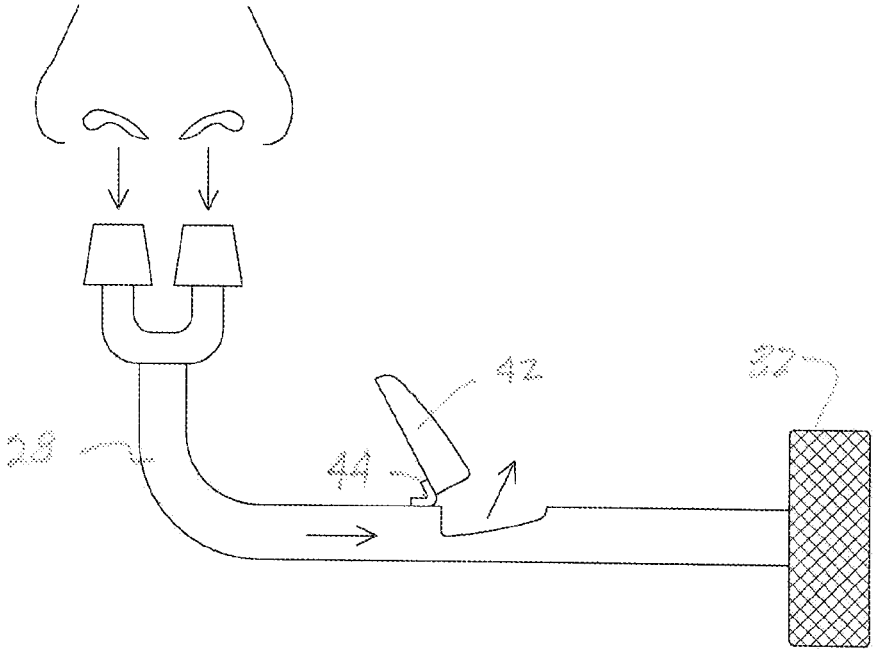
FIG. 3 illustrates the nasal filter of FIG. 2 during exhalation.

FIG. 2 schematically represents one form of nose or nasal filter 26 adapted for use with the present invention. The filter 26 includes a tubular segment 28 attached at a first end 30 to a filter 32. An opposite end 34 of the segment 28 is formed into a U-shaped portion having a pair of end members 36, 38. Each of the members 36,38 is fitted with a nose piece 40*a*, 40*b* that is sized and shaped to snugly fit into a nostril of a wearer. The tube segment 28 includes a valve 42 that is hinged to the tube at 44. The term "valve" as used herein is synonymous with the term "lid" or "cover" and is used to identify the moveable element 42 that opens and closes to control air movement therethrough. In FIG. 2 the valve 42 is shown in a closed position while FIG. 3 shows the valve in an open position. The open position is exaggerated it FIG. 3 to clearly illustrate the opening of the valve. However, in actual use, the valve 42 will only open slightly to allow air to escape. The cover 42 is normally closed due to its weight and gravity and stays closed during inhalation. It will be appreciated that the valve closes during inhalation due to the reduced pressure that will then exist inside the tube segment 28. During exhalation, the valve opens due to the increase in pressure inside the tube as compared to normal ambient air pressure. This embodiment forces inhalation air to be drawn in through the filter 32 while allowing exhaled air to bypass the filter 32. The direction of air flow in each of the two figures in indicated by the arrows 45. The filter 32 may be a separate filter media or may be the filter media of the mask portion 12, i.e., the tubular segment may simply terminate inside the mask portion 12.

Figure 5:
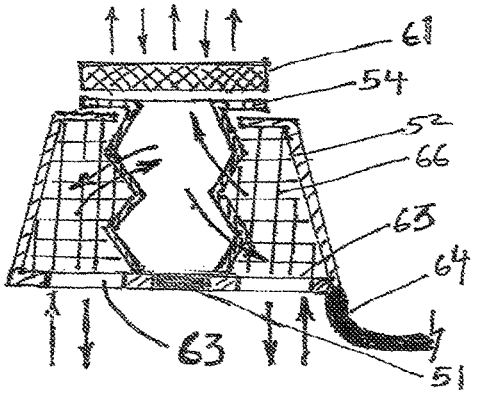
FIG. 5 is a unique nose filter with nose drip protection, larger filter element surface area for breathing comfort and an exhale cover.
Figure 6:
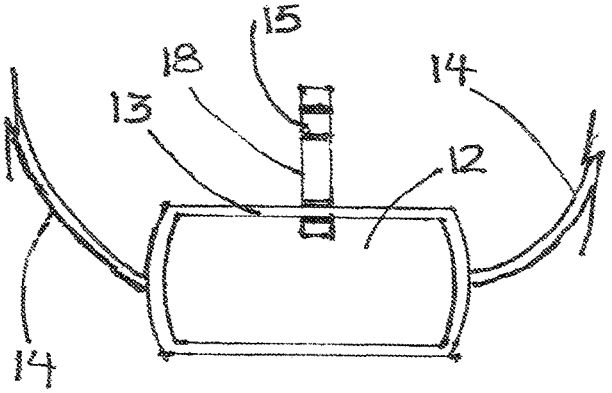
FIG. 6 shows a mouth mask with side straps and a coupling link to be tied to a nose filter insert tie.
Figure 4:
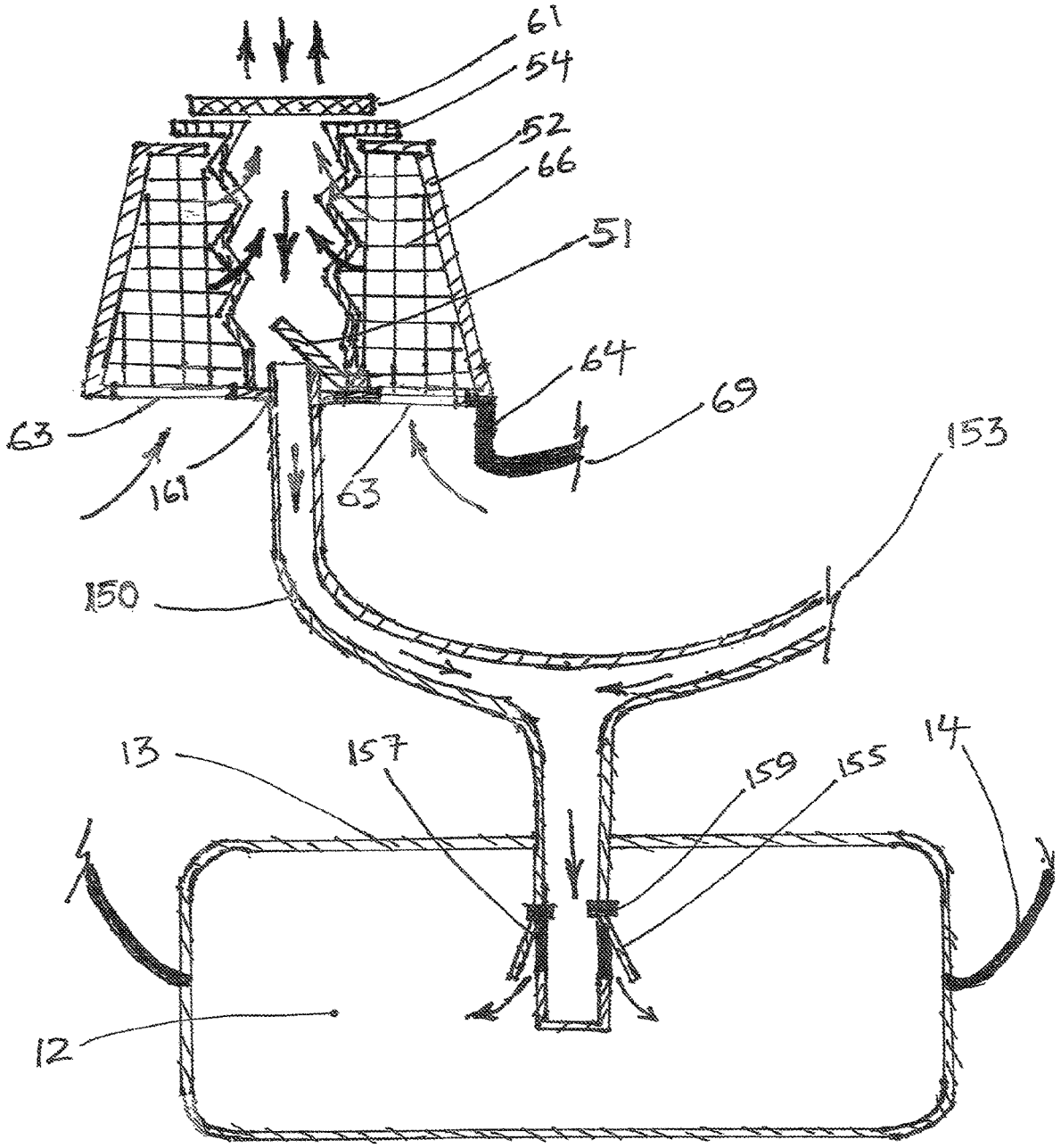
FIG. 4 shows a novelty embodiment where a micro filtered air is inhaled through a unique nose filter and exhaled into a mouth mask using gravity actuated cover.

FIGS. 4, 5 and 6 illustrate a new form of nasal and mouth filter forming a mask in accordance with one form of the present invention. For purposes of description the following reference numbers are used in these figures:

61—A drip protection sponge, replaceable and cleanable
54—An accordion-style filter element for greater surface area
52—Nose Insert or cage
66—Open space between insert and a filter element
161—An exhale port
51—An exhale cover
63—Inhale opening
64—Insert tie in link
69—Link continuation between inserts
150—Exhale tube
159—Hinge for gravity actuated cover
157—Exhaled air out opening
155—Gravity actuated cover
13—Mouth filter edge band
12—Mouth filter
14—Mouth filter attachment band
53—Open bottom of filter element A hybrid or a special combination of nose filter and a mouth mask provides a great solution to all associated problems with the conventional face mask. But still in this arrangement, a person has to form a habit to breathe in through nose filter and breathe out through mouth mask so as not to breathe in the exhaled impurities. With this novelty embodiment one can breathe in and breathe out through this novelty embodiment using a unique nose filter of FIG. 5 with a linking exhale tube 150 to exhale out into mouth mask 12. One inhales fresh air through inhale opening 63 and exhales out into mask 12 using a gravity actuated or controlled cover 155. But this is not all. Nose drips, nasal fluid and exhaust moisture clogs the filter within a nose filter and makes breathing harder. This unique nose filter of FIGS. 4, 5 and 6 uses a drip protection sponge 61, having sponge with least resistance to passing air and collects nasal fluid and moisture. Unique nose filter uses a filter element 54 shaped to give a large surface area for better comfort by breathing easier. An exhale port 161 and exhale cover 51 facilitate exhale tube 150 to be inserted and open an exhale cover 51 thereby exhaled air rush into mask 12 through air out opening 157 by pushing out a gravity actuated cover 155. Gravity cover 155 stands on hinge 159. Exhale tube 150 is an integral part of mouth mask 12. During eating or drinking or mouth wash, the exhale tube 150 is pulled out of exhale port 161 whereby mouth mask with tube 150 can be removed. Exhale cover closes once tube 150 is pulled out and now the exhaled air passes through filter 54 and exhaust through inhale opening 63. In this mode one inhales and exhales through inhale opening 63. Link 64 is continued with link 69 to tie into second nose filter insert.

Figure 7:
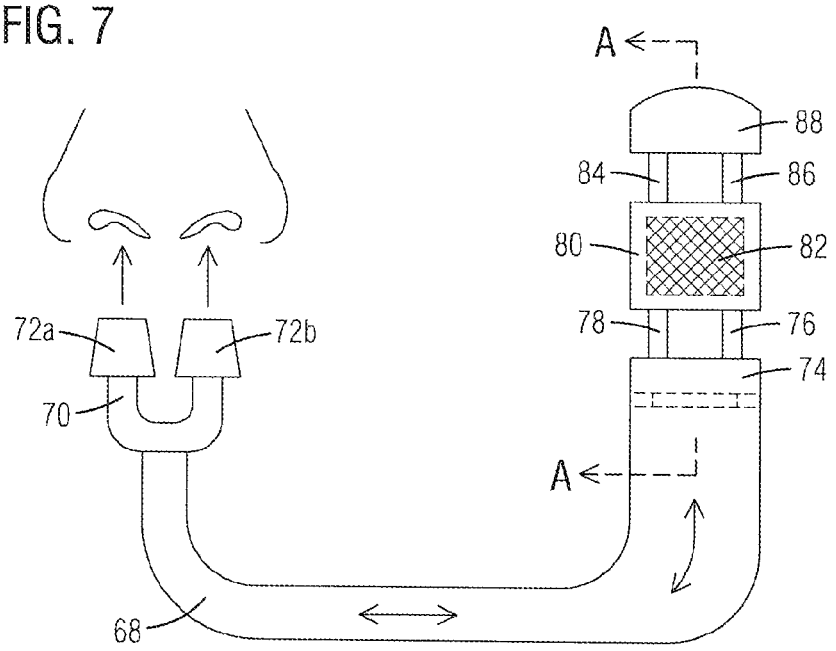
FIG. 7 is a schematic representation of another form of nose filter.
Figure 8A:
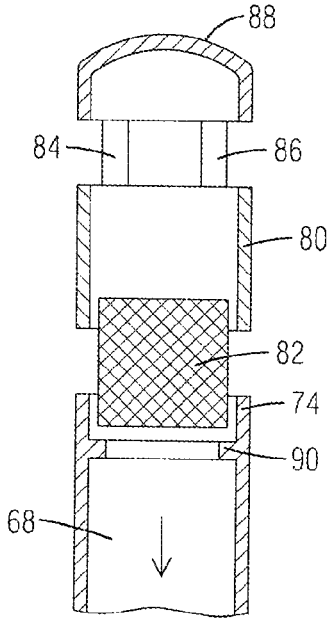
FIGS. 8A and 8B are cross sectional views of the position of an active part of the filter of FIG. 7 in an inhalation and an exhalation condition, respectively.
Figure 8B:
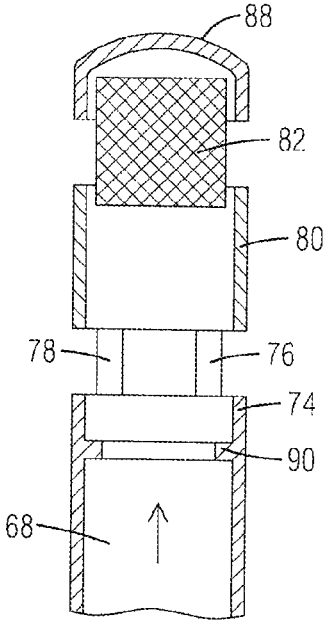

Turning now to FIG. 7 in conjunction with FIGS. 8A and 8B, there is shown another form of nose filter 69 that may be used in combination to form the present invention. FIG. 7 shows the filter end of the filter 69 in partial cross section so that the filter media member 82 is visible. FIGS. 8A and 8B are detail cross sections of the filter end of the filter 69. The filter 69 is somewhat similar to the filter 26 of FIG. 2 in having a pair of nasal inserts 72*a* and 72*b* that connect to a breathing tube 68 through a u-shaped connector 70. A distal end 74 of the tube 68 is connected to a sliding filter member 82 moveable within a housing 80. The member 82, which is equivalent to the filter 32 in function, is guided by a pair of posts designated at their respective upper ends by reference numbers 84, 86 and at their respective lower ends by reference numbers 78, 76. The posts ends 85,86 connect to and support a cap 88 which holds the posts in fixed alignment. The lower ends 76,78 of the posts are attached to a flange 90 fitted into the end 74 of the tube 68. In FIG. 7, the filter member 82 is shown in a neutral position while FIG. 8A shows the member 82 drawn down onto the flange 90 so that air entering the tube 68 must pass through the medium of the member 82. Incoming air is drawn in through the space between the cap 88 and the housing 80 In FIG. 8B, the member 82 is pushed outward by exhalation air so that air can exit the tube 68 through the space between the housing 80 and the tube end 74. Although not shown in the drawing, it will be recognized that the housing 80 is attached to both the cap 88 and the flange 90 so as to hold the housing in fixed relationship with the tube end 74. In a preferred embodiment, the housing 80 has an upper perforated section that extends into and is bonded to the cap 88 and a lower perforated section that extends to and is bonded to the flange 90.

Figure 9A:
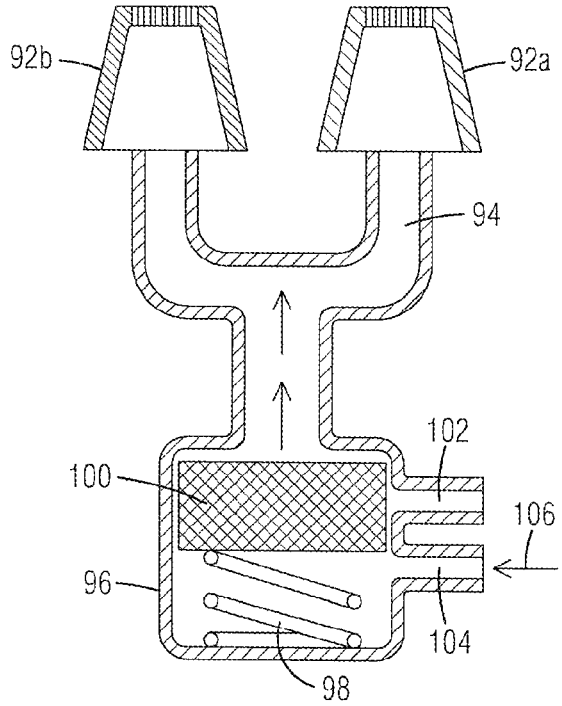
FIGS. 9A and 9B illustrate another embodiment of nose filter in an inhalation and an exhalation condition, respectively.
Figure 9B:
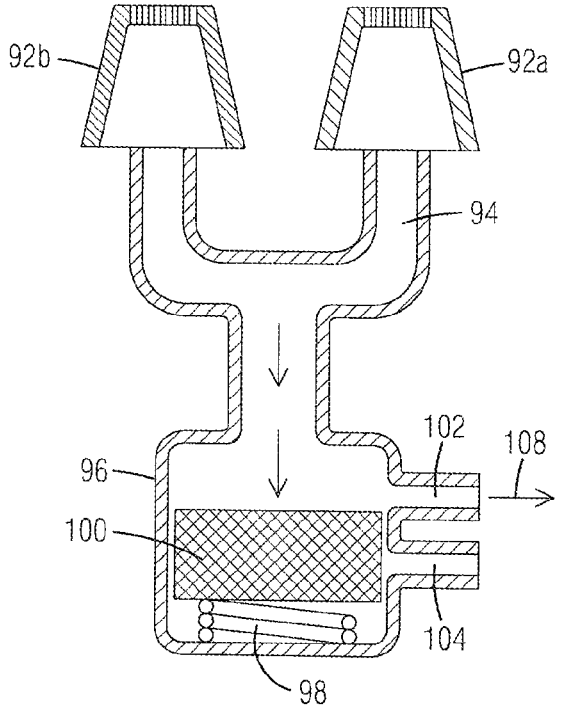

Still another form of nasal filter assembly is shown in FIGS. 9A and 9B. In this embodiment, a pair of nasal inserts 92*a*, 92*b* are connected to a y-shaped tube 94. The tube 94 connects to a chamber 96 in which is positioned a sliding filter member 100. The filter member may comprise a conventional microfilter material as previously described. In FIG. 9A, the member 100 is held in a position to force air entering the tube 94 to pass through the filter media. A spring 98 has sufficient resiliency, i.e., a low modulus of elasticity, to push the member 100 into the normal or resting upper position. When the wearer exhales, the force of the exhaled air is sufficient to push the filter member into its lower position as shown in FIG. 9B. When the filter member 100 is in the upper position shown in FIG. 9A for inhalation, air enters the chamber 96 via duct 104 and indicated by arrow 106. When the filter member 100 is in the lower position shown in FIG. 9B, air exits the duct 102 as indicated by arrow 108 and bypasses the filter member so that less force is required for exhalation. While the spring 98 is shown as one form of force that can be used to position the member 100, it will be appreciated that other forms of force could be used, such as for example, a low gauss magnet to attract the member upward with a magnetic material in the member 100. Another option could be to use a sponge-like material in place of the spring.

Figure 10:
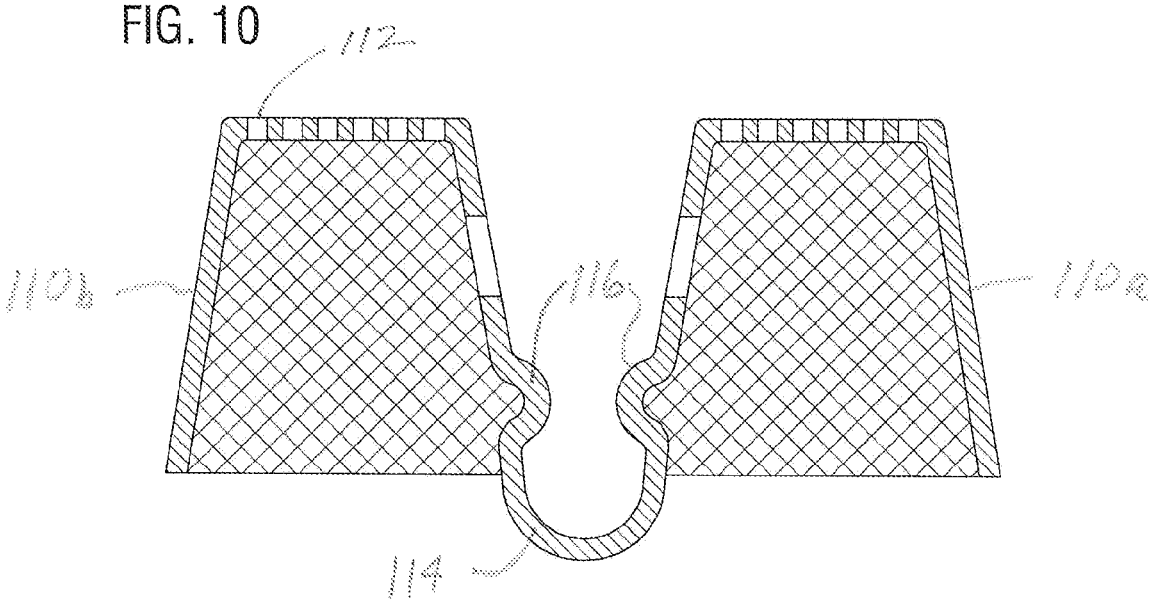
FIGS. 10 and 11 illustrate the form of a nose insert with spring clip to hold nose filter and a possible attachment in place.
Figure 11:
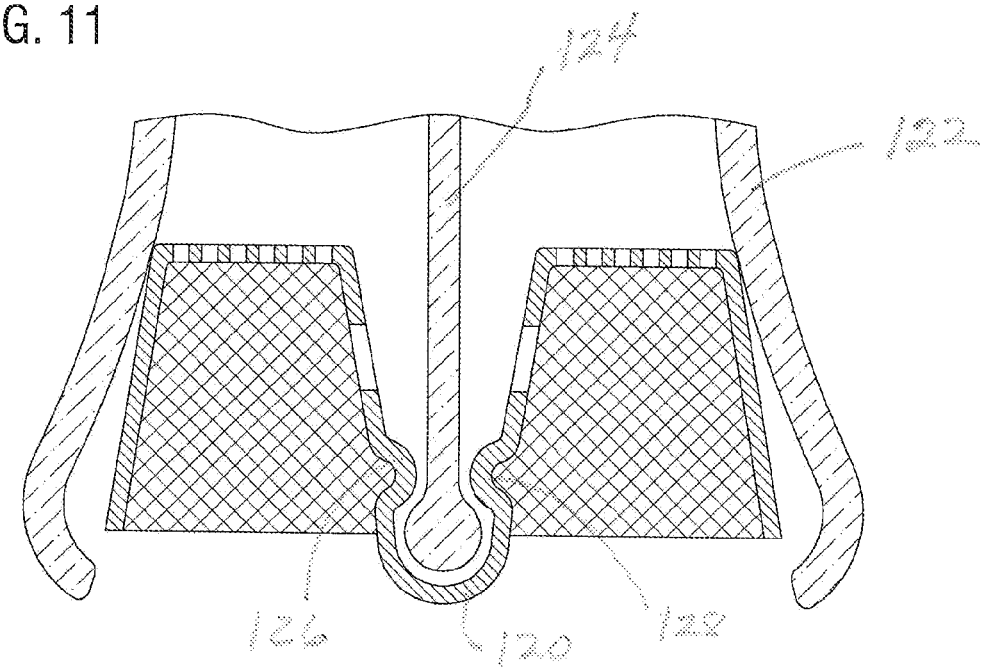

Turning now to FIGS. 10 and 11, there is shown a cross-sectional view of a different form of nasal insert 109 having a pair of insertable nasal members 110*a* and 110*b*. The insert 109 is designed with a center link 120 formed with a pair of opposing protrusions 116. The protrusions 116 extend in opposing relationship from the lower base of the inserts 109 and are arranged and adapted to engage the septum of the nose to hold the inserts in engaging relationship with the wearer's nose. The insert also includes perforations 112 for air passages. As shown in FIG. 11, the protrusions 116, labeled as a left protrusion 126 and a right protrusion 128 are arranged to fit over the nasal vestibule indicated at 130 at the base of the wearer's septum. This structure then holds the inserts in the respective nasal cavities of the wearer's nose.

Figure 12:
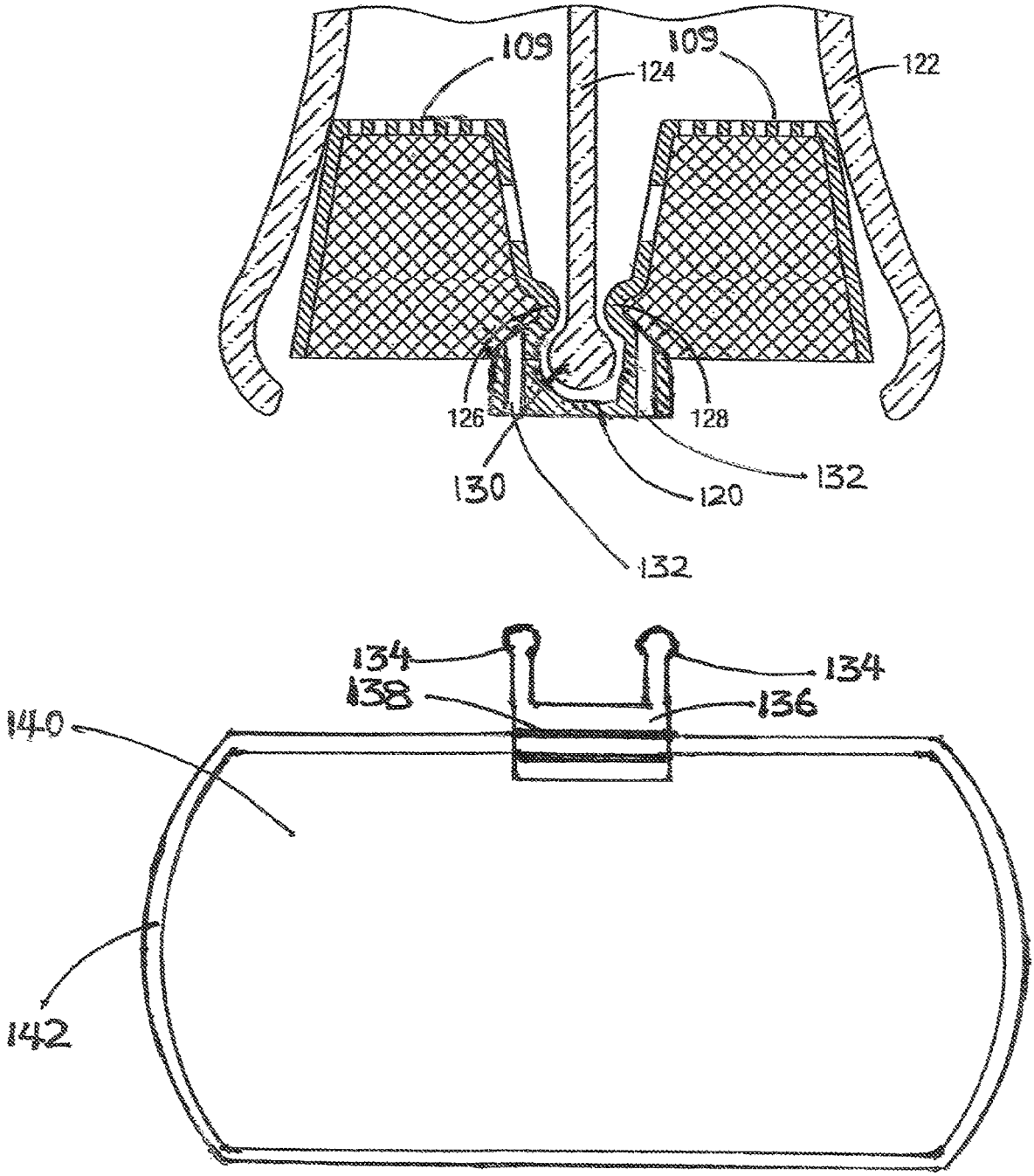
FIG. 12 shows an embodiment and arrangement for a mouth mask to be tied and hanged to special nose clips of the nose inserts via a coupling link and positioned over mouth without having side straps.

Turning now to FIG. 12 that illustrates a different hybrid mask arrangement where a mouth mask 140 can be hooked to a special nose clip 120, a part of nose insert 109, on both sides having holes 132 via a coupling link 136. A coupling link 136 has an insert knob on one side that snaps in to holes 132 and a face mask 140 tied on the other side into a slot 138. The protrusions 126 and 128 serve the same purpose as called out in FIGS. 10 and 11 to give good grip on the center cartilage of a nose. Insert knob 134 and holes 132 are sized and shaped to provide a proper grip to be held in a special clip 120. Mouth mask 140 along with coupling link 136 can be pulled out from a special nose clip 120 for eating or drinking. Elastic edge 142 can hold a certain position in slot 138 so as to cover the mouth portion appropriately.

While the invention has been described in conjunction with several different embodiments, it will be appreciated that other possible embodiments are contemplated as set forth in the appended claims. It is intended therefore that the invention not be limited to the specific disclosed embodiments but be interpreted within the full spirit and scope of the appended claims.

The terminology used herein is for the purpose of describing particular embodiments only and is not intended to be limiting. As used herein, the singular forms "a," "an," and "the" are intended to include the plural forms as well, unless the context clearly indicates otherwise. Furthermore, to the extent that the terms "including," "includes," "having," "has," "with," or variants thereof are used in either the detailed description and/or the claims, such terms are intended to be inclusive in a manner similar to the term "comprising." Moreover, unless specifically stated, any use of the terms first, second, etc., does not denote any order or importance, but rather the terms first, second, etc., are used to distinguish one element from another.

Unless otherwise defined, all terms (including technical and scientific terms) used herein have the same meaning as commonly understood by one of ordinary skill in the art to which embodiments of the invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

While various disclosed embodiments have been described above, it should be understood that they have been presented by way of example only, and not limitation. Numerous changes, omissions and/or additions to the subject matter disclosed herein can be made in accordance with the embodiments disclosed herein without departing from the spirit or scope of the embodiments. Also, equivalents may be substituted for elements thereof without departing from the spirit and scope of the embodiments. In addition, while a particular feature may have been disclosed with respect to only one of several implementations, such feature may be combined with one or more other features of the other implementations as may be desired and advantageous for any given or particular application. Furthermore, many modifications may be made to adapt a particular situation or material to the teachings of the embodiments without departing from the scope thereof.

Further, the purpose of the foregoing Abstract is to enable the U.S. Patent and Trademark Office and the public generally and especially the scientists, engineers and practitioners in the relevant art(s) who are not familiar with patent or legal terms or phraseology, to determine quickly from a cursory inspection the nature and essence of this technical disclosure. The Abstract is not intended to be limiting as to the scope of the present disclosure in any way.

Therefore, the breadth and scope of the subject matter provided herein should not be limited by any of the above explicitly described embodiments. Rather, the scope of the embodiments should be defined in accordance with the following claims and their equivalents.

The invention claimed is:

1. A hybrid disposable face mask for breathing comprising:

a first mask section having a filter area sized and shaped to fit in overlapping relationship only about the mouth area of a wearer;

at least one attachment strap connected to opposite edges of the mask section and adapted to enable the mask section to be held in position over the mouth area of the wearer;

a second mask section having a nose filter adapted to be inserted into each nostril of a wearer, the nose filter having a pair of flexible inserts, one for each nostril, that are sized and shaped to be sealably retained in the nostril;

an interlinking structure adapted to breathe in through the second mask section and to breathe out through the first mask section; and said hybrid disposable face mask adapted to have the first mask section to be moveable out of the mouth area for the consumption of food and while using the second mask section to breathing.

2. The hybrid face mask of claim 1, wherein the first mask section is coupled to the second mask section via a link that allows the first mask section to be separated from the second mask section to allow the wearer to eat or drink while breathing through the second mask section.

3. The hybrid face mask of claim 1, wherein said second mask section having a filter layer in said nose filter, sized and shaped to have maximum breathing area all around for least air transfer resistance and adapted for treatment with a spray of anti-virus, anti-germ material, said filter layer having one or more filter linings.

4. The hybrid face mask of claim 1, wherein said second mask section having a clip between said two inserts to be clipped to nose center cartilage for tight holding of nose filter and any external assembly, when attached, and wherein said external assembly is a resealable and releasable arrangement.

5. The hybrid face mask of claim 4, wherein said external assembly includes a removable coupling link attached to said first mask section such that said first mask section is held in place over the user's mouth without any other holding means.

6. The hybrid face mask of claim 1, wherein the second mask portion includes a nose filter with a replaceable and cleanable nasal drip protection sponge attached at the top of the nose filter, the sponge being sized and shaped to seal the air flow between a top periphery of the nose filter and the inner lining of the nose.

7. The hybrid face mask of claim 4, wherein said external assembly includes a removable exhalation tube connected to said nose inserts, said exhalation tube having an exhalation port, normally closed, that opens due to exhalation pressure within the tube and is further structured such that, when said external assembly is removed, causes the user to inhale and exhale through the nose filter.

8. The hybrid face mask of claim 7, wherein a distal end of said tube terminates in said first mask section.

9. The hybrid face mask of claim 4, wherein said external assembly includes a tube having an outside filtered air inhalation means and an exhalation port, normally closed, that is opened due to exhalation pressure build up withing the tube.

10. A hybrid disposable face mask for breathing comprising:

a first mask section having a filter area sized and shaped to fit in overlapping relationship only about the mouth area of the wearer;

at least one attachment strap connected to opposite edges of the mouth section and adapted to enable the mask section to be held in position over the mouth area of the wearer, said first mask section further gives protection by filtering an incidental inhaling of an outside air and having means to be moved out of the mouth area to enable the wearer to consume food;

a second mask section having inserts one for each nostril, sized and shaped to be sealably retained air tight in each nostril and linked to a valve assembly, primarily to breathe in and out through a filter and having at least one of a gravity or a spring or an elastic or a magnetic media as a means to operate the valve for getting fresh air in and exhaled air out.

11. The hybrid face mask of claim 1, and including a tube connected at a first end in breathing relationship to each of the inserts, a second end of the tube being connected to a microfilter for allowing fresh air in, and a gravity lid valve positioned in the tube for diverting exhaled air out of the tube prior to the microfilter.

12. The hybrid face mask of claim 4, and including a flexible link coupling the pair of nasal inserts, the link connected to the inserts via a respective protrusion extending in opposing arrangement from each insert, the protrusions being arranged and adapted to engage the septum of the nose of the wearer for holding the inserts and any attached external assembly in engaging relationship with the wearer's nose.

* * * * *